US005857793A

United States Patent [19]

Bossert et al.

[11] Patent Number: 5,857,793

[45] Date of Patent: Jan. 12, 1999

[54] REFILL CARTRIDGE FOR A STICK AND A METHOD FOR FILLING THE CARTRIDGE

[75] Inventors: Marie-Claude Bossert, Erkrath; Joachim Franken; Tilwin Lepsius, both of Duesseldorf, all of Germany

[73] Assignee: Henkel Kommanditgesellschaft auf Aktien, Duesseldorf, Germany

[21] Appl. No.: 727,580

[22] PCT Filed: Apr. 15, 1995

[86] PCT No.: PCT/EP95/01423

§ 371 Date: Nov. 18, 1996

§ 102(e) Date: Nov. 18, 1996

[87] PCT Pub. No.: WO95/28856

PCT Pub. Date: Nov. 2, 1995

[30] Foreign Application Priority Data

Apr. 22, 1994 [DE] Germany ..... P 44 14 019.3

[51] Int. Cl.[6] ..... B05C 17/00; A45D 40/16

[52] U.S. Cl. ..... 401/75; 401/68; 401/98; 401/134; 401/175

[58] Field of Search ..... 410/75, 68, 134, 410/175, 98, 63, 79

[56] References Cited

U.S. PATENT DOCUMENTS

| | | | |
|---|---|---|---|
| 1,947,738 | 2/1934 | Reutter | 401/75 |
| 2,574,405 | 11/1951 | Lynn | 401/63 X |
| 4,369,158 | 1/1983 | Woodruff et al. | 401/79 X |

FOREIGN PATENT DOCUMENTS

| | | | |
|---|---|---|---|
| 1961542 | 7/1971 | Germany | 401/134 |
| 41 16 581 | 5/1992 | Germany . | |
| 41 20 969 | 5/1992 | Germany . | |

*Primary Examiner*—Steven A. Bratlie
*Attorney, Agent, or Firm*—Ernest G. Szoke; Wayne C. Jaeschke; Kenneth Watov

[57] ABSTRACT

The invention is associated with a refill cartridge for a stick which applies product by rubbing onto a surface, comprising a tube-like element, which is designed to be tightly closed at both ends and of which one end is designed to fit tightly onto a tube element of the stick; a longitudinally displaceable plunger with a screwthreaded bore—onto which a screwthreaded spindle of the adhesive stick projecting from the tube element is designed to be screwed—being non-rotatably guided in the tube-like element; and the tube-like element being filled with a product which bears against the plunger at one end and, the product in an extension of the screwthreaded bore, is formed throughout with a bore in which the screwthreaded spindle engages when the refill cartridge is fitted onto the stick. The bore in the product is formed via the tube-like element being releasably closed at its free end by a sealingly fitted cap-like closure element, the cap-like closure element being internally formed with a pin-like projection which fills the intended area of the bore extending throughout the product in a liquified state. After the product solidifies, removal of the cap and its associated pin-like projection leaves the bore fully formed in the product.

12 Claims, 3 Drawing Sheets

REFILL CARTRIDGE FOR A STICK AND A METHOD FOR FILLING THE CARTRIDGE

BACKGROUND

1. Field of the Invention

This invention relates to a refill cartridge for a stick which applies product by rubbing onto a surface, such as an adhesive stick.

2. Discussion of Related Art

Refill cartridges of this type and a corresponding method for filling them are known from applicants' DE 41 20 969 A1 and also from DE 41 16 581 A1. They are particularly suitable for refilling adhesive sticks, but also other sticks which apply product by rubbing onto a surface, such as deodorant sticks, lipsticks, lubricant sticks, shaving soap sticks or crayons. The main advantage of these refill cartridges is that, when the stick is empty, its key non-consumable elements can be repeatedly reused by quasire-filling of the stick with a refill cartridge, for which purpose the initially closed refill cartridge is fitted onto and secured to the stick, the screwthreaded spindle of the stick being introduced into the refill cartridge and screwed into the plunger so that it can then engage in the bore formed over the entire length of the product of the refill cartridge.

Although a refill cartridge of the type in question has considerable advantages, it has been found that the production and filling of such a refill cartridge with initially liquid product involve disadvantages in view of the need to form a bore throughout the product to receive the screwthreaded spindle. Thus, in the method according to DE 41 20 969 A1, the empty refill cartridge closed at its bottom end is initially introduced into a mold in which a pin extending over the mold—for receiving the screwthreaded bore of the plunger and for forming the bore extending throughout the product—is arranged at the bottom of the mold concentrically of its longitudinal axis. The product is then poured in and, after the product has solidified, the pin forming the bore in the product has to be removed. The refill cartridge then has to be tightly closed at both ends to ensure that the product does not come into contact with the surrounding air.

SUMMARY OF THE INVENTION

Accordingly, the problem addressed by the present invention is to enable a refill cartridge of the type in question to be produced and filled more easily and to remain satisfactorily sealed after filling.

In a refill cartridge of the type mentioned at the beginning, the solution provided by one embodiment of the invention includes a tube-like element releasably closed at its free end by a sealingly fitted cap-like closure element, the cap-like closure element being internally formed with a pin-like projection which fills the bore extending throughout the product.

A refill cartridge designed in this way is much easier to make and to fill. Thus, the product may initially be poured in liquid form into the refill cartridge closed at its bottom end, after which the cap-like closure element is sealingly fitted, with the pin-like projection forming the desired bore in the product while it is still in the liquid state. The length of the pin-like projection is such that a bore extending over the entire length of the product is formed. When the refill cartridge is used by the consumer, the cap-like closure element merely has to be removed from the refill cartridge, thus uncovering the bore extending through the solid product.

In one particularly advantageous embodiment, the length of the pin-like projection is such that the free end thereof engages at least locally in the screwthreaded bore of the plunger in the fully fitted state of the cap-like closure element. This ensures that even the screwthreaded bore of the plunger is substantially free from product so that, when the refill cartridge is used, the screwthreaded spindle of the pin can readily be screwed in.

In another particularly advantageous embodiment, the cap-like closure element and/or the outer receiving zone of the tube-like element for the cap-like closure element is/are provided with co-operating, encircling stop means which are designed in such a way that, before the stop means cross over one another, the pin-like projection penetrates fully through the product. In this way, the required full-length screwthreaded bore can be produced in two stages by initially loosely applying the closure cap with its pin-like projection after filling product for the purpose of air equalization, with the pin-like projection being centered by the cap-like closure element and by the entry of the tip of the pin-like projection into the screwthreaded part of the plunger. After the filling product has cooled, a sealing closure and, at the same time, further penetration of the pin-like projection into the screwthreaded part of the plunger are achieved by application of pressure to the cap-like closure element and by crossing of the stop means over one another, with small amounts of filling in the region of the screwthread bore being laterally displaced past the tip of the pin-like projection.

In another particularly advantageous embodiment, the cap-like closure element is flexible and the pin-like projection is rigid, in order to establish an effective seal between the cap-like closure element and the tube-like element of the refill cartridge and, on the other hand, to enable the pin-like projection to penetrate satisfactorily through the product.

To avoid accumulations of material, the cap-like closure element and the pin-like projection are preferably in two parts designed to be releasably interconnected.

Another particularly advantageous embodiment is characterized in that the screwthreaded bore of the plunger and/or the associated opening in the bottom of the tube-like element are covered by a protective film or the like. The protective film or thin zone in the bottom of the container seals off the refill cartridge from outside, while the protective film in the region of the screwthreaded bore of the piston ensures that when the liquid product is poured in, it cannot pass completely into and thus block the bore.

Depending on the filling materials, the free end of the pin-like projection may advantageously be pointed, conical or stepped.

In another advantageous embodiment, the tube-like element is externally provided with at least one longitudinal groove. This longitudinal groove co-operates with a fillet internally provided on the tube element of the stick and affords protection against rotation, as known from FIG. 6 of DE 41 16 581 A1.

To solve the problem stated at the beginning, the invention also provides a method for filling a refill cartridge of the type described in the foregoing with initially liquid and subsequently solidifying product, in which product is poured into the plunger-equipped refill cartridge closed at its bottom end. This method being characterized in that, after the product has been poured in and before it solidifies, the cap-like closure element is fitted onto the corresponding end of the tube-like element in such a way that the pin-like projection penetrates fully into the liquid product to form a bore.

In one particularly advantageous embodiment, the cap-like closure element is initially fitted onto the tube-like element to such an extent that the free end of the pin-like projection only projects into the region of the screw-threaded bore of the plunger and, after solidification of the product, the cap-like closure element is fully and sealingly fitted onto the tube-like element by crossing of the stop means over one another. In this way, air equalization, i.e. an outward escape of air, can initially occur during filling, following which the refill cartridge is tightly closed after solidification of the product.

BRIEF DESCRIPTION OF THE DRAWINGS

The invention is described in more detail in the following with reference to the accompanying drawings, in which like items are identified by the same reference designation, wherein.

DETAILED DESCRIPTION OF THE INVENTION

Figure 1:
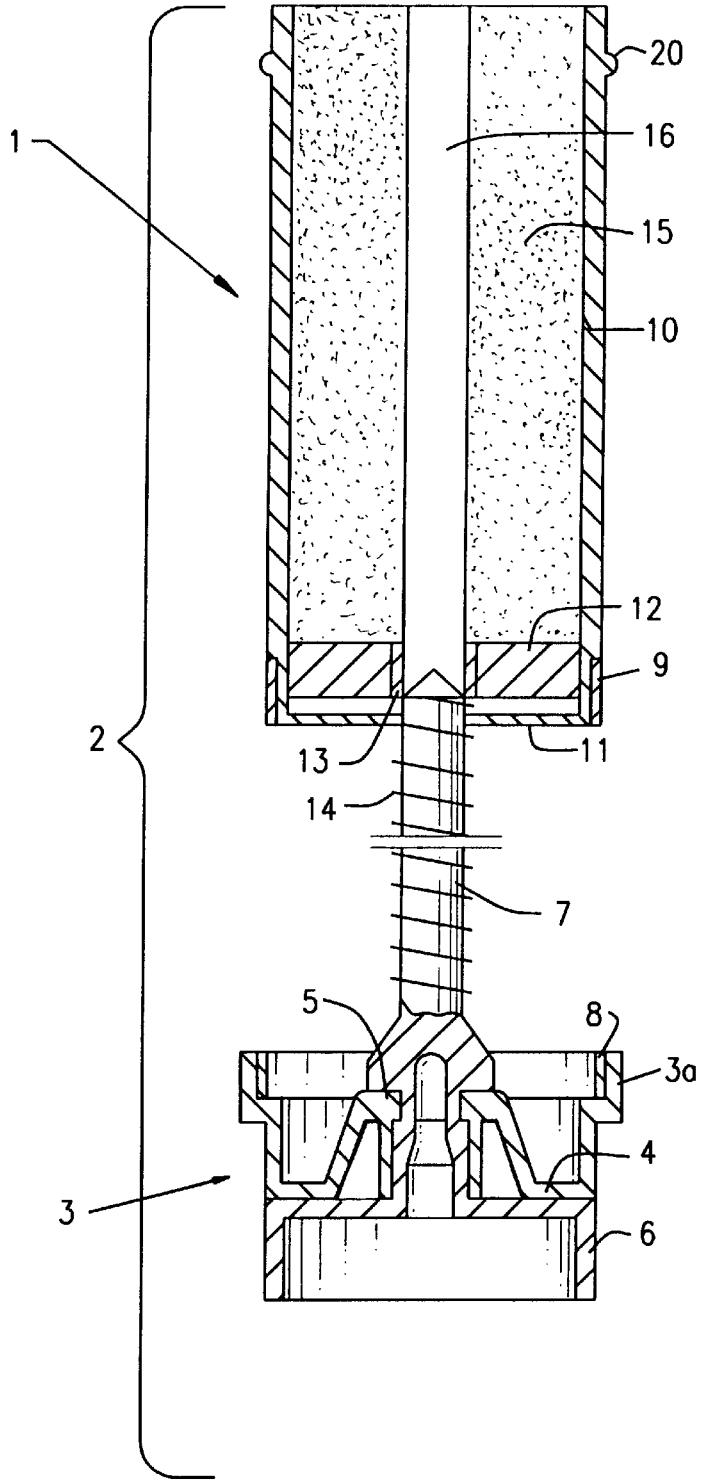
FIG. 1 is a section through a refill cartridge according to one embodiment of the invention during fitting onto a stick.

A refill cartridge according to the invention for a stick which applies product by rubbing onto a surface is globally denoted by the reference 1 in the drawings. In the illustrated embodiment, the refill cartridge 1 is intended for an adhesive stick, forming part of the adhesive stick after fitting or joining thereto. Accordingly, the adhesive stick as a whole, including the refill cartridge 1, is denoted by the reference 2. Besides adhesive sticks, a refill cartridge according to the invention is also suitable for other product sticks designed to apply a small amount of product onto a surface by rubbing on that surface, for example deodorant sticks, lipsticks, lubricant sticks, shaving soap sticks or crayons. In the interests of clarity, however, the following description refers solely to an adhesive stick or adhesive product, but is not meant to limit the invention thereto.

Apart from the refill cartridge 1, which is part of the adhesive stick 2, the adhesive stick 2 comprises a tube element 3 with a continuous base 4 which merges into an encircling snap-action fastening 5 for receiving a knurled nut 6 with a screwthreaded spindle 7 projecting upwards from the tube element 3. The tube element 3 widens upwards towards one end. This region is denoted by the reference 3*a* and is provided internally with an internal screwthread 8 for securing the corresponding end of the refill cartridge 1, for which purpose the refill cartridge 1 is provided with a corresponding outer thread 9.

Figure 2:
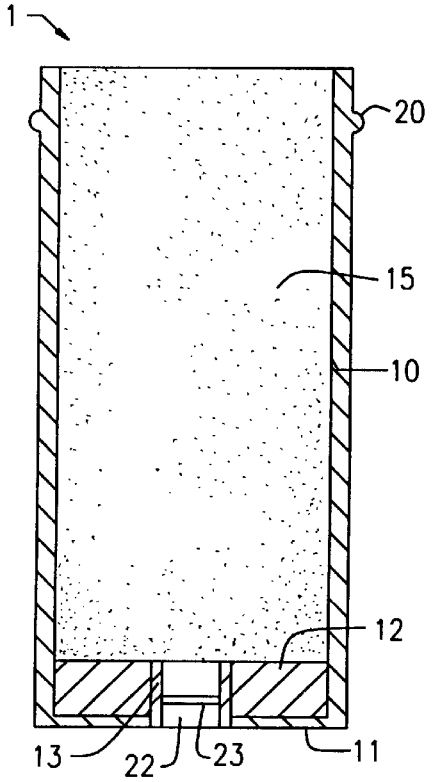
FIG. 2 shows the refill cartridge during filling.

The refill cartridge 1 itself comprises a tube-like element 1 with a substantially continuous base 11 which is centrally provided with a thin zone, a push-through zone or the like denoted by the reference 22 in FIG. 2. Arranged inside the refill cartridge 1 is a longitudinally displaceable plunger 12 with a screwthreaded bore 13 which is non-rotatably guided in the tube-like element 10 (not shown in detail), the screwthreaded bore 13 corresponding with the outer screwthread 14 of the screwthreaded spindle 7 of the adhesive stick 1. Above the plunger 12, the tube-like element 10 of the refill cartridge 1 is filled with an adhesive product 15 which is provided over its entire length with a bore 16 that forms an extension of the screwthreaded bore 13 of the plunger 12.

Figure 3:
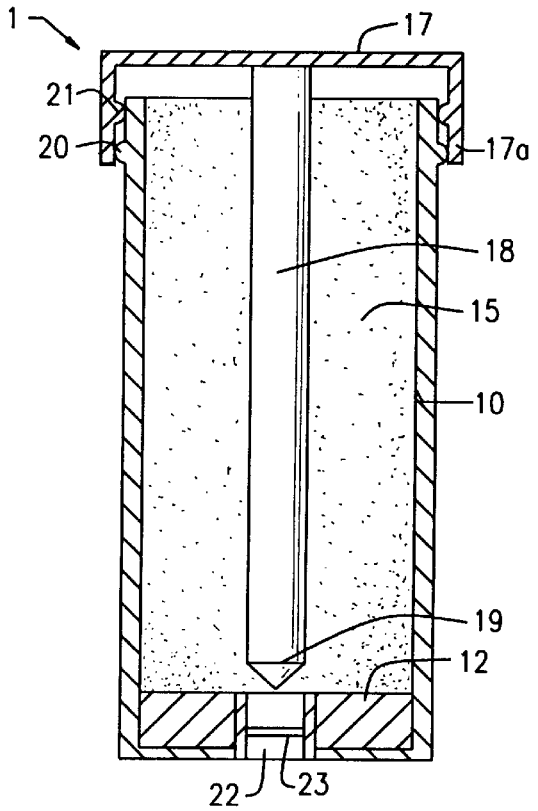
FIG. 3 shows the refill cartridge after filling during the fitting of a cap-like closure element for one embodiment of the invention.
Figure 4:
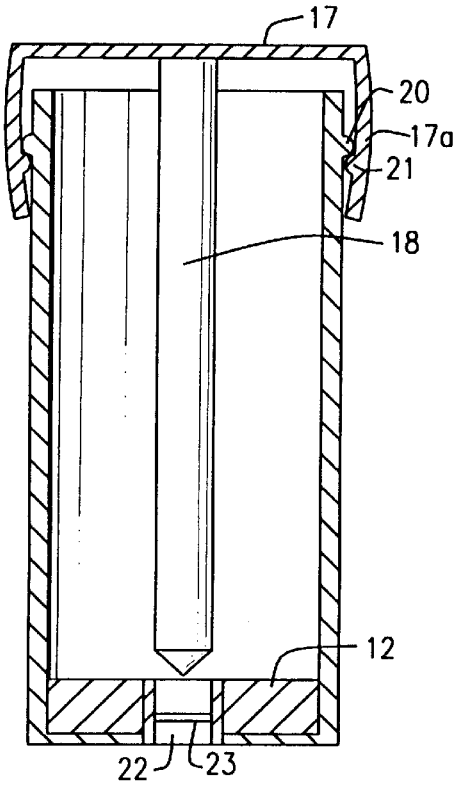
FIG. 4 shows the refill cartridge in its fully closed state.
Figure 5:
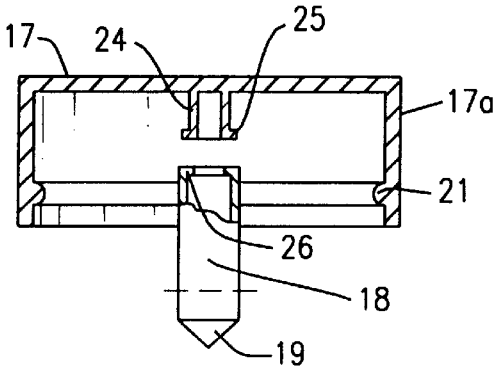
FIG. 5 shows an embodiment of the cap-like closure element.

As can best be seen from FIGS. 3 to 5, the refill cartridge 1 additionally comprises a cap-like closure element 17 designed to be fitted onto the free end of the tube-like element 10 from outside. The cap-like closure element 17 is internally provided with a pin-like projection 18 of which the length is such that the free end 19 of the pin-like projection 18 engages at least locally in the screwthreaded bore 13 of the plunger 12 in the fully fitted state of the cap-like closure element 17.

The cap-like closure element 17 and the outer receiving zone of the tube-like element 10 for the cap-like closure element 17 are provided with co-operating encircling stop means 20,21 which, in the embodiment illustrated, are formed by snap-action beads. However, the stop means could also assume any other form, for example a screw connection. The function of the stop means 20,21 is to enable the cap-like closure element 17 to be initially fitted onto the tube-like element 10 in a first fitting position (FIG. 3) and, after the stop means 21 have crossed over the stop means 20, to be fully and tightly fitted onto the tube-like element 10.

Before the refill cartridge 1 is filled, it is preferably closed twice at its bottom end, i.e. once by means of the push-through zone or thin zone 22 and then by a protective film 23 or the like which covers the screwthreaded bore 13 of the plunger 12.

After the plunger 12 has been introduced into the tube-like element 10, the adhesive product 15 is poured in liquid form into the tube-like element 10 until the tube-like element 10 is substantially full. The protective film 23 in the region of the screwthreaded bore 13 prevents the adhesive from completely filling and blocking the screwthreaded bore 13.

While the adhesive 15 is still liquid, the cap-like closure element 17 is fitted onto the tube-like element 10 of the refill cartridge from above, as shown in FIG. 3, in such a way that the stop means 20,21 come into contact with one another without crossing so that the sealing side wall region 17*a* of the cap-like closure element 17 does not yet seal off the refill cartridge 1 at its upper end. At the same time, the pin-like projection 18 of the cap-like closure element 17 penetrates centrally into the liquid product 15 and, acting as a core, forms the desired bore 16 throughout the product 15. Through the choice of a suitable length for the pin-like projection 18, the free end 19 of the pin-like projection penetrates slightly into the screwthreaded bore 13 and is centered therein.

When the adhesive 15 has hardened sufficiently, the cap-like closure element 17 is fully applied by crossing of the stop means 20 over the stop means 21 so that, on the one hand, tight closure of the upper end of the refill cartridge 1 is guaranteed, because the stop means 20,21 bear tightly against one another, and on the other hand the free end 19 of the pin-like projection 18 penetrates so far into the screwthreaded bore 13 that any residues of adhesive present there are pushed aside.

Accordingly, the refill cartridge 1 is ready for use through formation of the bore 16 extending throughout the product 15 and may be marketed in this form.

If, now, the refill cartridge 1—as part of an adhesive stick 2—is fixed to the adhesive stick 2, as shown in FIG. 1, the cap-like closure element 17 is removed and the tube-like element 10 of the refill cartridge 1 is screwed onto the tube element 3 of the adhesive stick 2. At the same time, the screwthreaded spindle 7 of the adhesive stick 2, after penetrating the thin zone 22 and the protective film 23, enters the screwthreaded bore 13 of the plunger 12 of the refill cartridge 1 so that the product 15 is able to pass over screwthreaded spindle 7 without difficulty.

A closure cap may then be applied to the tube-like element 10 at its upper end in order to seal off the tube-like element 10.

In one particular embodiment, the cap-like closure element 17 itself may be used as the closure cap providing, as shown in FIG. 5, the cap-like closure element 17 and the pin-like projection 18 are in two parts releasably joined to one another. To this end, the cap-like closure element 17, as shown in FIG. 5, is internally provided with a central cylindrical projection 24 with an encircling stop bead 25 onto which the hollow pin-like projection 18 is designed to fit via a corresponding inner bead 26. If, now, the pin-like projection 18 is removed from the cap-like closure element 17, the cap-like closure element 17 may be used as a closure cap for the adhesive stick 2.

The cap-like closure element 17 is preferably made of a flexible plastic, while the pin-like projection 18 is rigid which guarantees effective sealing of the tube-like element 10 by the cap-like closure element 17, and satisfactory formation of the bore 16 in the adhesive product 15 by the pin-like projection 18.

Depending on the products used, the free end 19 of the pin-like projection 18 of the cap-like closure element 17 may assume various forms. In the embodiments shown in FIGS. 2 to 5, the free end 19 is pointed whereas, in the embodiment shown in FIG. 6, the free end 19*a* is rounded. In the embodiment shown in FIG. 7, the free end 19*b* is stepped.

Figure 6:
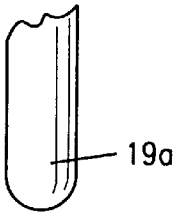
FIGS. 6 and 7 show embodiments of the free end of the pin-like projection of the cap-like closure element.
Figure 7:
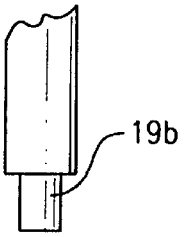
Figure 8:
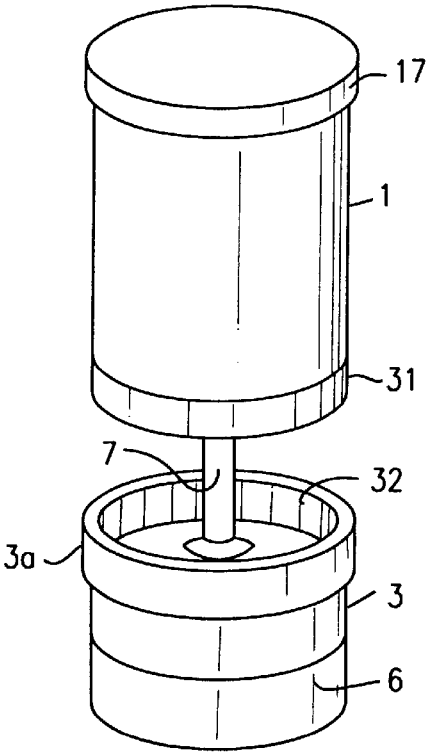
FIG. 8 shows details of the longitudinal grooves and longitudinal fillets of the tube element and refill cartridge for an embodiment of the invention.

In addition to the embodiment shown in FIG. 1, the tube-like element 10 of the refill cartridge 1 may be externally provided with longitudinal grooves 31 (see FIG. 8) which co-operate with longitudinal fillets 32 on the inside of the tube element 3 and stop the tube-like element 10 from rotating in the tube element 3, as known in detail from DE 41 16 581 A1 and described therein with reference to FIG. 6 of the drawings. Through this additional anti-rotation measure, which has not been shown in the drawings, the refill cartridge 1 can be introduced into the tube element 3 without difficulty.

The invention is not of course confined to the illustrated embodiments. Further embodiments of the invention are possible without departing from the basic concept. For example, the connection between the cap-like closure element 17 and the tube-like element 10 of the refill cartridge 1 may assume a different form and may even consist, for example, of a screw connection or the like. Such further embodiments, which may be recognized by those of skill in the art, are meant to be covered by the spirit and scope of the appended claims.

What is claimed is:

1. A refill cartridge for a stick applicator which applies product by rubbing the product onto a surface, such as with an adhesive stick, comprising:

said refill cartridge including:

a hollow tubular body for containing said product;

a longitudinally displaceable plunger including a centrally located screwthreaded bore, said plunger being initially retained within an opening in a bottom end of said tubular body;

a cap-like closure element internally formed with a centrally located elongated pin-like projection, whereby when said closure element is secured to a top end of said tubular body for closing off the same, said pin-like projection extends through said product, thereby forming an elongated central bore through said product;

said stick applicator including:

a base member having an upper portion configured to receive and tightly be secured to the bottom of said tubular body of said refill cartridge;

a centrally located screw threaded spindle protruding from said upper portion for screwing initially into said screwthreaded bore of said plunger, and into the central bore of said product after said cap-like closure element and its pin-like projection are removed from the top of said tubular body of said refill cartridge; and means in a lower portion of said base member for rotating said screwthreaded spindle in a direction for moving said plunger toward the open end of said tubular body to force a desired portion of said product therefrom.

2. A refill cartridge as claimed in claim 1, wherein the length of the pin-like projection is such that the free end thereof engages at least locally in the screwthreaded bore of the plunger in the fully fitted state of the cap-like closure element.

3. A refill cartridge as claimed in claim 1, wherein the cap-like closure element, and the outer surface of the tubular body proximate its top end receptive of the cap-like closure element are provided with cooperating, encircling stop means which are designed in such a way that, before the stop means cross over one another, the pin-like projection penetrates fully through the product.

4. A refill cartridge as claimed in claim 1, wherein the cap-like closure element is flexible and the pin-like projection is rigid.

5. A refill cartridge as claimed in claim 1, wherein the cap-like closure element and the pin-like projection are in two parts designed to be releasably interconnected.

6. A refill cartridge as claimed in claim 1, wherein the screwthreaded bore of the plunger and the opening in the bottom of the tubular body are covered by a protective film.

7. A refill cartridge as claimed in claim 1, wherein the free end of the pin-like projection is pointed.

8. A refill cartridge as claimed in claim 1, wherein the tubular body is provided with at least one longitudinal groove proximate its bottom end.

9. A refill cartridge as claimed in claim 1, wherein the free end of the pin-like projection is rounded.

10. A refill cartridge as claimed in claim 1, wherein the free end of the pin-like projection is stepped.

11. A method for filling a refill cartridge with initially liquid and subsequently solidifying product, said refill cartridge including a hollow tubular body for containing said product, a longitudinally displaceable plunger including a centrally located screwthreaded bore, said plunger being initially retained within an opening in a bottom end of said tubular body, a cap-like closure element internally formed with a centrally located elongated pin-like projection, whereby when said closure element is secured to a top end of said tubular body for closing off the same, said pin-like projection extends through said product thereby forming an elongated central bore through said product; said method including the steps of:

pouring product into the plunger-equipped refill cartridge closed at its bottom end, and after the product has been poured in and before it solidifies, fitting the cap-like closure element onto the top end of the tubular body in such a way that the pin-like projection penetrates fully into the liquid product to form a bore.

12. A method as claimed in claim 1, said fitting step further including the step of:

the cap-like closure element onto the top end of said tubular body, before solidification of said product, to such an extent that the free end of the pin-like projection only projects into the region of the screwthreaded bore of the plunger.

* * * * *